US007411125B2

(12) United States Patent
Yamada et al.

(10) Patent No.: US 7,411,125 B2
(45) Date of Patent: Aug. 12, 2008

(54) CHORD ESTIMATION APPARATUS AND METHOD

(75) Inventors: Keiichi Yamada, Tokyo (JP); Tatsuki Kashitani, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/811,542

(22) Filed: Jun. 11, 2007

(65) Prior Publication Data

US 2007/0289434 A1 Dec. 20, 2007

(30) Foreign Application Priority Data

Jun. 13, 2006 (JP) ..... 2006-163922

(51) Int. Cl.
*G10H 1/38* (2006.01)
*G10H 7/00* (2006.01)

(52) U.S. Cl. ..... 84/637

(58) Field of Classification Search ..... 84/613, 84/637

See application file for complete search history.

(56) References Cited

U.S. PATENT DOCUMENTS 6,057,502 A * 5/2000 Fujishima ..... 84/637
2007/0095197 A1* 5/2007 Kobayashi et al. ..... 84/654
2007/0112558 A1* 5/2007 Kobayashi ..... 704/201

FOREIGN PATENT DOCUMENTS

JP 2000-298475 10/2000

OTHER PUBLICATIONS

Randal J. Leistikow et al., "Bayesian Identification of Closely-Spaced Chords from Single-Frame STFT Peaks.", Proc. of the 7th Int. Conference on Digital Audio Effects (DAFx'04), Oct. 5-8, 2004.

* cited by examiner

*Primary Examiner*—Jeffrey Donels
(74) *Attorney, Agent, or Firm*—Frommer Lawrence & Haug LLP; William S. Frommer

(57) ABSTRACT

A chord estimation apparatus includes: frequency-component extraction means for extracting a frequency component from an input music signal; scale-component information generation means for mapping the frequency component extracted by the frequency-component extraction means onto each tone and generating scale-component information including each tone and loudness thereof; folding means for folding the scale-component information generated by the scale-component information generation means for each two octaves to generate scale-component information including 24 tones; and chord estimation means for inputting the scale-component information including 24 tones into a Bayesian network in order to estimate a chord.

7 Claims, 7 Drawing Sheets

CHORD ESTIMATION APPARATUS AND METHOD

CROSS REFERENCES TO RELATED APPLICATIONS

The present invention contains subject matter related to Japanese Patent Application JP 2006-163922 filed in the Japanese Patent Office on Jun. 13, 2006, the entire contents of which are incorporated herein by reference.

BACKGROUND OF THE INVENTION

1. Field of the Invention

The present invention relates to an apparatus and method for estimating a chord corresponding to an input musical signal.

2. Description of the Related Art

To date, as a technique for estimating a chord corresponding to an input musical signal, a technique, in which frequency-component data extracted from a musical signal is folded for each one octave (12 tones including C, C#, D, D#, E, F, F#, G, G#, A, A#, B) to generate an octave profile, and the octave profile is compared with a standard chord profile to estimate a chord, has been known (refer to Japanese Unexamined Patent Application Publication No. 2000-298475).

Also, in recent years, a technique, in which a chord is estimated using a Bayesian network having the frequency of a frequency peak after performing short-time Fourier transform on a musical signal and the loudness thereof, a root (root tone), a chroma (chord type: major, minor, etc.), etc., as nodes, has also been known (refer to Randal J. Leistikow et al., "Bayesian Identification of Closely-Spaced Chords from Single-Frame STFT Peaks.", Proc. of the 7th Int. Conference on Digital Audio Effects (DAFx'04), Oct. 5-8, 2004).

SUMMARY OF THE INVENTION

Here, a chord is played by an instrument called a musical instrument which emits a sound having a harmonic structure. This harmonic structure plays a significant role for the chord being recognized as a sound having pitches by a human sense of hearing. In this regard, harmonics have frequencies that are integer multiples of the frequency of a fundamental tone. When expressed by musical tones, a second, a third, and a fourth harmonics correspond to the tone one octave higher than the fundamental tone, the tone one octave and seven semitones (perfect fifth) higher, and the tone two octaves higher, respectively.

However, in the technique described in Japanese Unexamined Patent Application Publication No. 2000-298475, a sound of a few octaves is folded for each one octave, and thus the harmonic structure of the sound is also folded. It becomes therefore difficult to distinguish a musical sound originated from a musical instrument from an unpitched sound originated from an unpitched musical instrument emitting a sound having no definite harmonic structure. Thus, there is a problem in that the estimation accuracy of a chord becomes deteriorated.

On the other hand, in the technique described in "Bayesian Identification of Closely-Spaced Chords from Single-Frame STFT Peaks.", the folding for each one octave is not carried out, and thus the harmonic structure can be taken into consideration. However, the frequency of a frequency peak after short-time Fourier transform and the loudness thereof are directly input into a Bayesian network, and thus there is a problem in that the amount of calculation for estimating a chord has become large.

The present invention has been proposed in view of these known circumstances. It is desirable to provide a chord estimation apparatus and method capable of estimating a chord corresponding to an input musical signal with a high degree of accuracy and with a small amount of calculation.

According to an embodiment of the present invention, there is provided a chord estimation apparatus including: frequency-component extraction means for extracting a frequency component from an input music signal; scale-component information generation means for mapping the frequency component extracted by the frequency-component extraction means onto each tone and generating scale-component information including each tone and loudness thereof; folding means for folding the scale-component information generated by the scale-component information generation means for each two octaves to generate scale-component information including 24 tones; and chord estimation means for inputting the scale-component information including the 24 tones into a Bayesian network in order to estimate a chord.

According to another embodiment of the present invention, there is provided a method of estimating a chord, including the steps of: extracting a frequency component from an input music signal; mapping the frequency component extracted by the step of extracting a frequency component onto each tone and generating scale-component information including each tone and loudness thereof; folding the scale-component information generated by the step of generating scale-component information for each two octaves to generate scale-component information including 24 tones and inputting the scale-component information including the 24 tones into a Bayesian network in order to estimate a chord.

By the chord estimation apparatus and method according to the present invention, it becomes possible to estimate a chord corresponding to an input musical signal with a high degree of accuracy in consideration of the harmonic structure and with a small amount of calculation.

DESCRIPTION OF THE PREFERRED EMBODIMENTS

In the following, a detailed description will specifically be given of an embodiment of the present invention with reference to the drawings. In this embodiment, a description will be given on the assumption that a corresponding chord is estimated on a musical signal mainly recorded on a musical medium, such as a CD (Compact Disc), etc. However, the musical signal that can be used for the chord estimation is, of course, not limited to the musical signal recorded on a recording medium.

Figure 1:
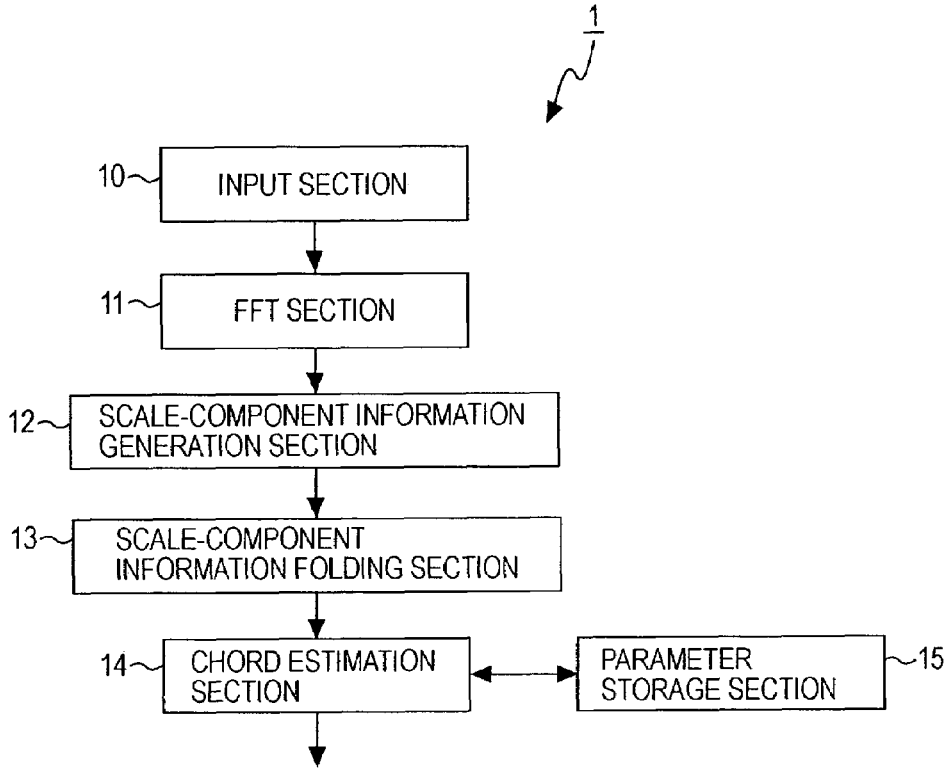
FIG. 1 is a diagram illustrating the schematic configuration of a chord estimation apparatus according to the present embodiment.

First, FIG. 1 illustrates the schematic configuration of a chord estimation apparatus according to the present embodiment. As shown in FIG. 1, a chord estimation apparatus 1 includes an input section 10, an FFT (Fast Fourier Transform) section 11, a scale-component information generation section 12, a scale-component information folding section 13, a chord estimation section 14, and a parameter storage section 15.

The input section 10 receives the input of a musical signal recorded on a musical medium, such as a CD, etc., and down samples, for example from 44.1 kHz to 11.05 kHz. The input section 10 supplies the musical signal after the down sampling to the FFT section 11.

The FFT section 11 performs Fourier Transform on the musical signal supplied from the input section 10 to generate the frequency component data, and supplies this frequency component data to the scale-component information generation section 12. At this time, the FFT section 11 should preferably set the window length and the FFT length in accordance with the frequency band. In this embodiment, the subsequent scale-component information generation section 12 is assumed to map the frequency peak onto seven octaves (84 tones) from C1 (32.7 Hz) to B7 (3951.1 Hz). Thus, for example, the window length and the FFT length can be set a shown in the following Table 1 such that, for example, the 84 tones are divided into four groups, and a frequency peak having a three-semitone distance from one another can be resolved in each group.

TABLE 1

| Group | Tone | Window Length (Sample) | FFT Length (Sample) |
|---|---|---|---|
| 1 | C1 to D#2 | 3276 | 16384 |
| 2 | E2 to D#4 | 1638 | 8192 |
| 3 | E4 to D#6 | 409 | 2048 |
| 4 | E6 to B7 | 102 | 512 |

The scale-component information generation section 12 adds the loudness of the frequency bin corresponding to each tone from C1 to B7 in the frequency direction, and adds the loudness of a sound from a beat to the next beat for each tone on the basis of the beat detection information from the existing musical-information processing system not shown in the figure to generate the scale component information including individual loudness of 84 tones. The scale-component information generation section 12 supplies the scale-component information including the 84 tones to the chord estimation section 14.

The scale-component information folding section 13 folds the scale-component information including 84 tones in odd octaves and even octaves, respectively, for each tone type (C, C#, D, . . . , B) to generate the scale-component information including 24 tones. In this manner, by folding the scale-component information including 84 tones in 24 tones, it is possible to reduce the amount of calculation in the chord estimation section 14 in the subsequent stage. Furthermore, the scale-component information folding section 13 normalizes the folded 24 tones by the loudness of the loudest tone. In this regard, the affluence of harmonics is related to the loudness of a physical sound. However, for the musical signal recorded on the musical medium as described above, the loudness of a sound is modified through various operations, and thus the relationship with the loudness of the physical sound is little. Accordingly, there is not a problem with the normalization in particular.

The chord estimation section 14 estimates a chord using a Bayesian network on the basis of the scale component information including 24 tones and the parameters stored in the parameter storage section 15, and outputs the estimated chord to the outside. In this regard, the details on the method of estimating a chord in the chord estimation section 14 will be described later.

Next, a description will be given of a method of estimating a chord in the chord estimation section 14. In the following, for the sake of convenience in description, first, a description will be given of a Bayesian network structure and the chord estimating method thereof when 84 tones are folded in one octave (12 tones) and then a triad is estimated from 12 tones. Next, a description will be given of a Bayesian network structure and the chord estimating method thereof when a triad is estimated from 24 tones. Lastly, a description will be given of a Bayesian network structure and the chord estimating method thereof when a triad and a tetrachord are estimated from 24 tones, that is to say, when the estimation target is expanded to a tetrachord.

1. Estimation of Triad from 12 Tones

Figure 2:
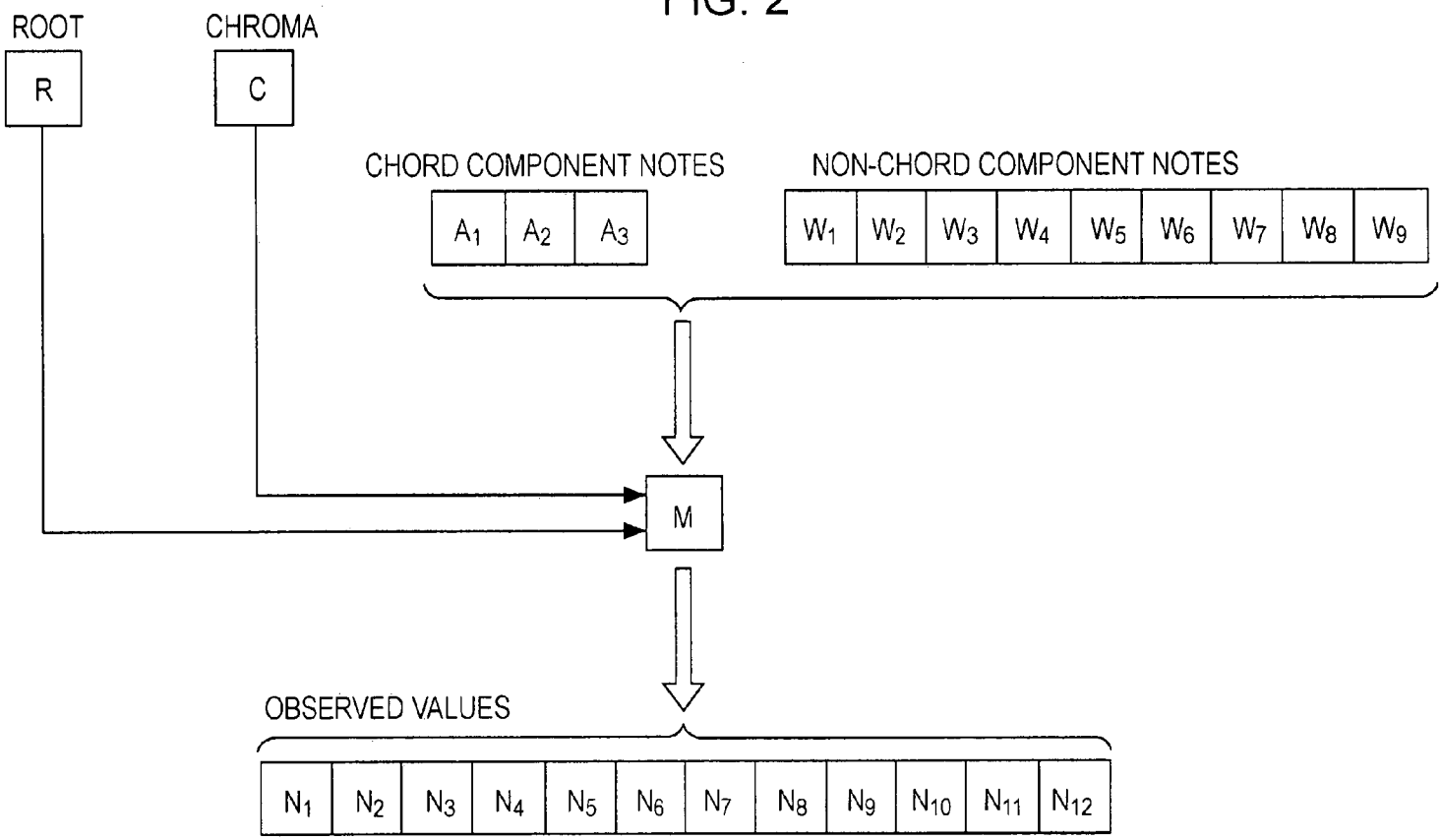
FIG. 2 is a diagram illustrating a model for estimating a triad from 12 tones.
Figure 3:
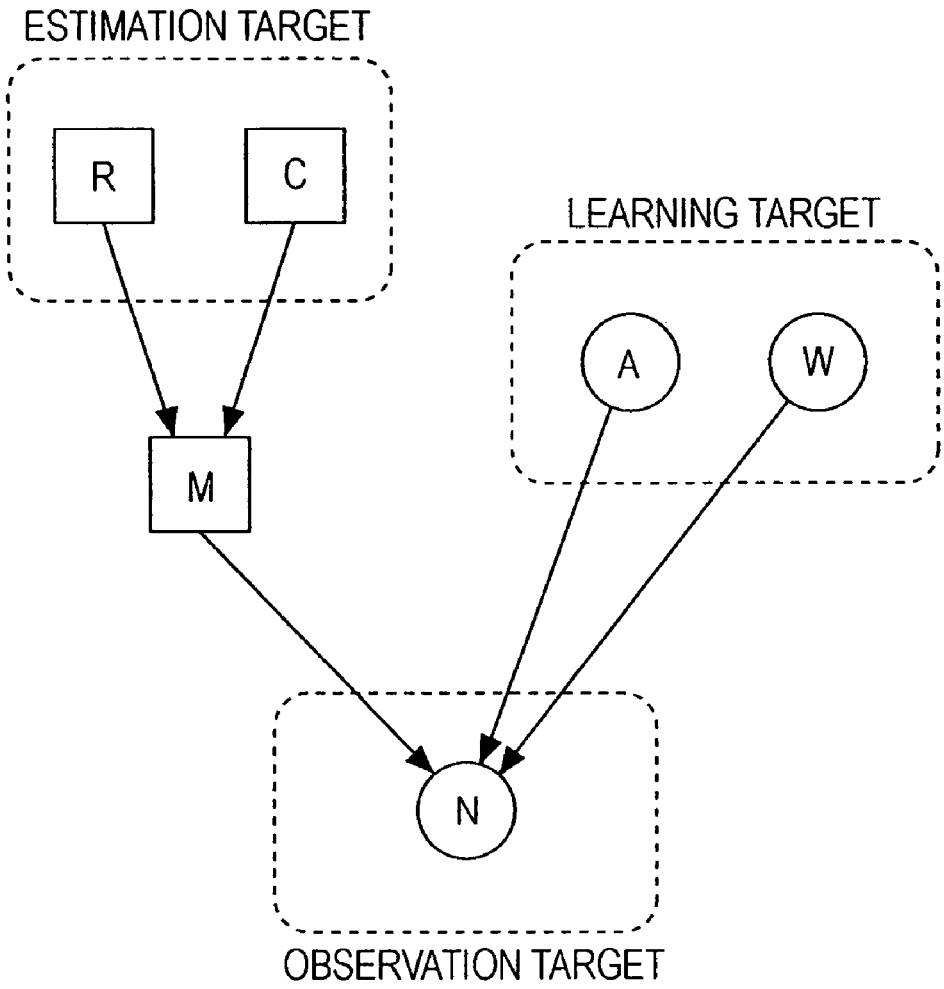
FIG. 3 is a diagram illustrating a Bayesian network structure for estimating a triad from 12 tones.

As shown in FIG. 2, in the estimation of a triad from 12 tones, an observation model is assumed in combination of a root tone, a third, a fifth, and the other tones in accordance with a root (root tone) and a chroma (chord type). This model is expressed by a Bayesian network structure as shown in FIG. 3. The characteristics of each node are shown in the following Table 2.

TABLE 2

| | Node | Characteristic | Prior Distribution |
|---|---|---|---|
| R | Root | 1 Element · 12 Values | Uniform Distribution |
| C | Chroma | 1 Element · 2 Values | Uniform Distribution |
| A | Loudness of Chord component Tones | 3 Elements · Continuous Value | Three Dimensional Gaussian Distribution |
| W | Loudness of Non-chord component Tones | 9 Elements · Continuous Value | Independent Identical Gaussian Distribution |
| M | Mixture | Virtual Node | |
| N | Observation | 12 Elements · Continuous Value | |

The node R represents a root, and includes one element. Also, the value of the node R can be one of 12 values, {C, C#, D, . . . , B}. The node R is an estimation target, and thus the prior distribution is assumed to be uniform distribution.

The node C represents a chroma, and includes one element. Also, the value of the node C can be one of two values, either major or minor. The node C is an estimation target, and thus the prior distribution is assumed to be uniform distribution.

The node A represents the loudness of the chord component tones, that is to say, the loudness of three tones included in a chord, and includes three elements, a root tone ($A_1$), a third ($A_2$), and a fifth ($A_3$). Also, the value of the node A can be a continuous value. The prior distribution of the node A is assumed to be three-dimensional Gaussian distribution.

The node W represents the loudness of the non-chord component tones, that is to say, the loudness of tones that are not the tones included in the chord. The tones include the difference when the three chord component tones are subtracted from 12 tones, namely, 12−3=9 elements ($W_1$ to $W_9$). Also, the value of the node W can be a continuous value. The prior distribution of the node W is assumed to be independent for each tone and identical Gaussian distribution (Independent and Identical Distribution; IID). In this regard, the average value and variance parameters are set from the statistics of the non-chord component tones of the correct answer data.

The node M is a virtual node, and mixes a chord component root tone, a third, a fifth, and the other tones in accordance with the root and the chroma. The node M is determined from the parent node deterministically, and thus can be omitted.

The node N represents the loudness of each tone of the scale component information, that is to say, it represents 12 tones, and includes 12 elements ($N_1$ to $N_{12}$). Also, the node N can be a continuous value.

In the Bayesian network structure having the individual nodes described above, the node M is provided as a child node of the nodes R and C, and the node N is provided as a child node of the node M. Also, the node N is a child node of the nodes A and W.

When a Bayesian network is learned, a correct answer root and a correct answer chroma are given to the nodes R and C, and the scale component information including 12 tones is given to the node N, and thereby the parameters of the node A are learned. The learned parameters are stored in the parameter storage section 15. On the other hand, when a chord is estimated using the Bayesian network after the learning, the learned parameters are read from the parameter storage section 15 and the scale component information including 12 tones is given to the node N, and thereby the posterior probabilities of the root and the chroma at the nodes R and C are calculated. Then, the combination of the root and the chroma having the highest posterior probability is output as an estimated chord.

An example in which a Bayesian network was actually learned, and a chord was estimated is shown as follows. For the musical signal of 26 pieces of music (popular music in Japan and English-speaking countries), the start time, the end time, the root and the chroma of the portions that were determined to be sounding a chord by a human being are recorded. All the correct answer data includes 1331 correct answer samples. The observed values (scale component information including 12 tones), the correct answer roots, and the correct answer chromas are given to the Bayesian network. Then, for the node A, three parameters as the average values and three parameters as covariance diagonal elements were learned using the EM (Expectation Maximization) method.

After the Bayesian network was learned in this manner, a chord was estimated using the same observed values as that used in the learning. The result was that correct answers are obtained for 1045 samples out of 1331 samples, and thus the correct answer rate was 78.5%.

Furthermore, the correct answer data was sorted in the order of occurrence sequence, and was grouped into two groups, an odd entry group and an even entry group. When the learning was done with odd entries and the evaluation was performed with even entries, the correct answer rate was 77.7%. Also, when the learning was done with the even entries and the evaluation was done with the odd entries, the correct answer rate was 78.8%. The correct answer rate has not changed much between the two, and thus it is understood that the correct answer rate has increased not by the overfitting to the correct answer data.

2. Estimation of Triad from 24 Tones

In the estimation of a triad from the 12 tones described above, the tones in 7 octaves are folded in one octave, and thus the harmonic structure of the sound is also folded. Thus, it becomes difficult to distinguish the sound originated from a musical instrument from the unpitched sound originated from an unpitched musical instrument emitting a sound having no definite harmonic structure. Accordingly, the estimation accuracy of a chord becomes deteriorated.

Thus, in the chord estimation section 14 in the present embodiment, a chord is actually estimated from two octaves, namely 24 tones.

Figure 4:
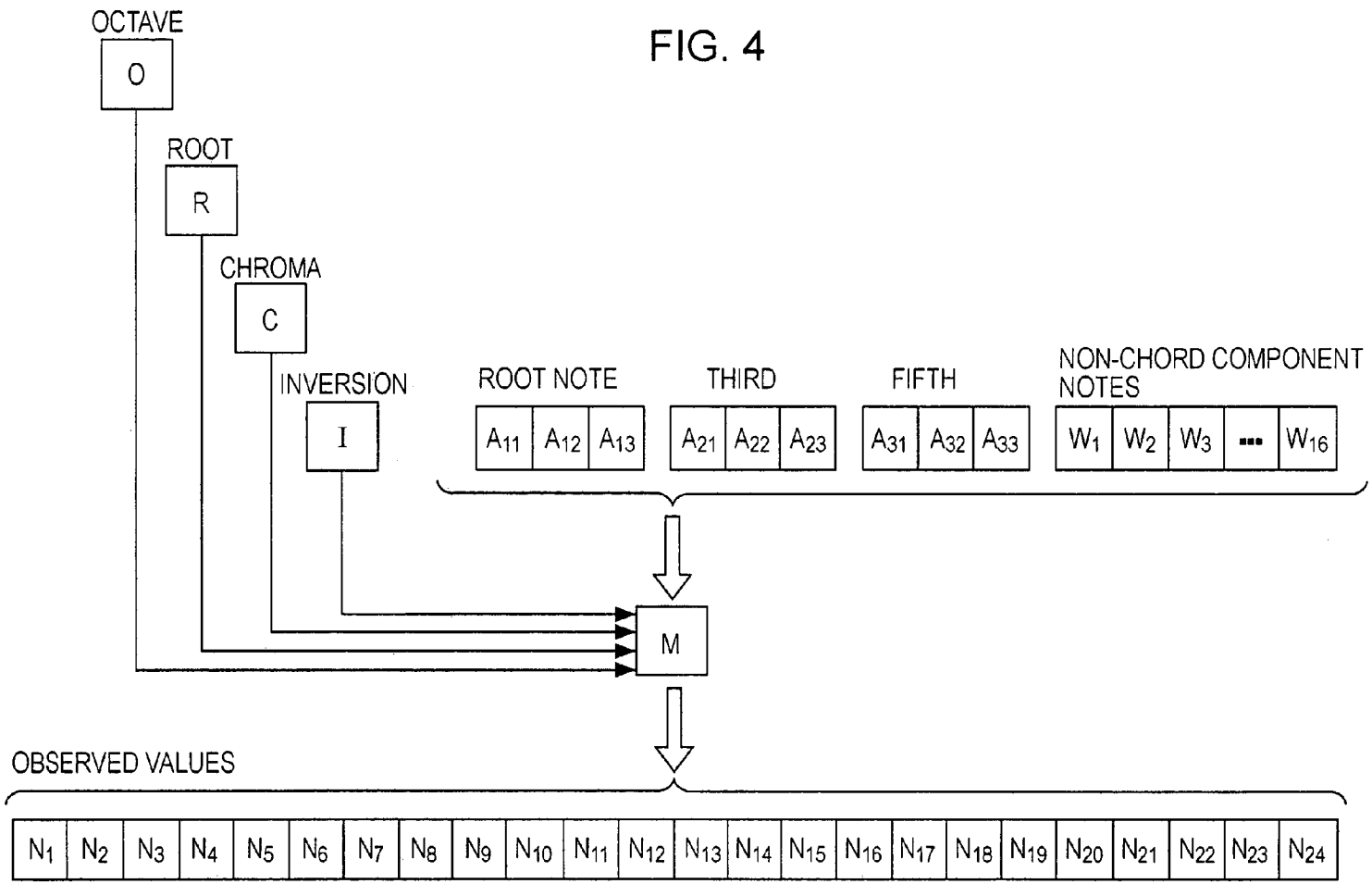
FIG. 4 is a diagram illustrating a model for estimating a triad from 24 tones.
Figure 5:
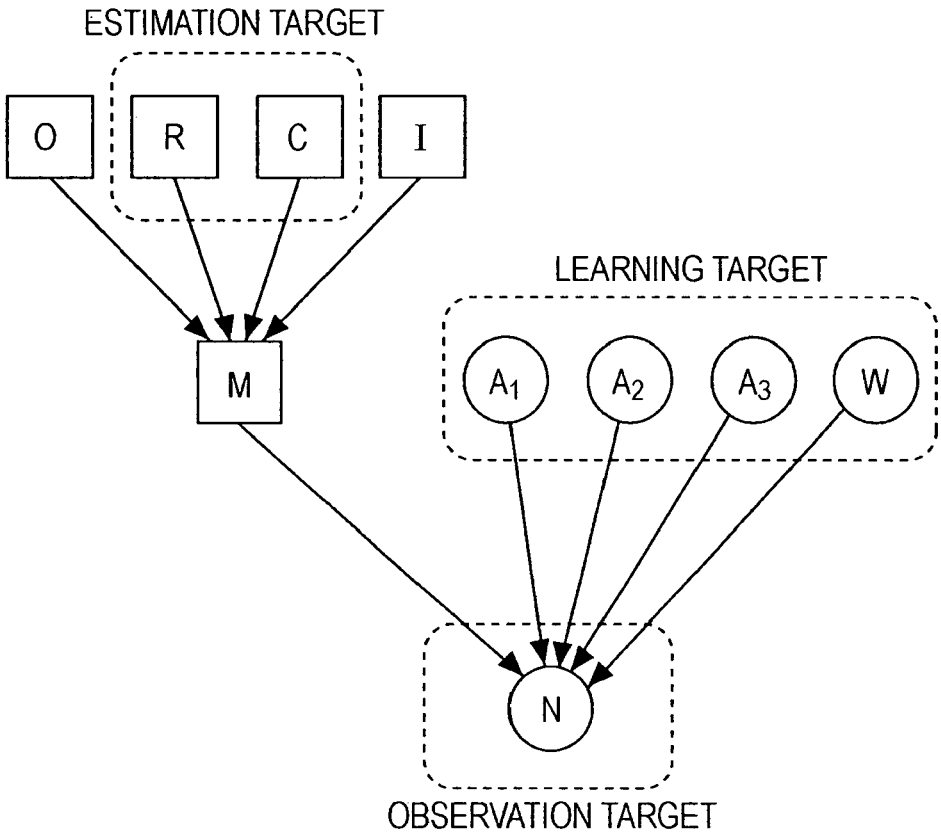
FIG. 5 is a diagram illustrating a Bayesian network structure for estimating a triad from 24 tones.

As shown in FIG. 4, in the estimation of a triad from 24 tones, an observation model is assumed in combination of a root tone, a third, a fifth, which are components of a chord, the second and third harmonics thereof and the other tones in accordance with a root, a chroma, an octave, and inversion (inverted-type of the chord). This model is expressed by a Bayesian network structure as shown in FIG. 5. The characteristics of each node are shown in the following Table 3.

TABLE 3

| Node | | Characteristic | Prior Distribution |
|---|---|---|---|
| O | Octave | 1 Element · 2 Values | Uniform Distribution |
| R | Root | 1 Element · 12 Values | Uniform Distribution |
| C | Chroma | 1 Element · 2 Values | Uniform Distribution |
| I | Inversion | 1 Element · 4 Values | Uniform Distribution |
| $A_1$ | Loudness of Fundamental Tone and Harmonics | 3 Elements · Continuous Value | Three Dimensional Gaussian Distribution |
| $A_2$ | Loudness of Third and Harmonics | 3 Elements · Continuous Value | Three Dimensional Gaussian Distribution |
| $A_3$ | Loudness of Fifth and Harmonics | 3 Elements · Continuous Value | Three Dimensional Gaussian Distribution |
| W | Loudness of Non-chord Component Tones | 16 Elements · Continuous Value | Independent Identical Gaussian Distribution |
| M | Mixture | Virtual Node | |
| N | Observation | 24 Elements · Continuous Value | |

The node O represents the octave including the chord out of the two octaves, and includes one element. Also, the value of the node O can be one of 2 values because of the two octaves. The prior distribution of the node O is assumed to be uniform distribution.

The node I represents the inversion, and includes one element. Also, the value of the node I can be one of four values. The prior distribution of the node I is assumed to be uniform distribution.

Here, there are eight combinations in the different ways which three chord component tones are distributed in two octaves. The combinations can be expressed by the two-valued node O and the four-valued node I. For example, when the chord is C major (={C, E, G}), there are following eight combinations as shown in Table 4. In this regard, "+12" in the inversion means that the tone has moved to one octave higher.

TABLE 4

| Combination | Octave 1 | Octave 2 | Octave | Inversion |
|---|---|---|---|---|
| 1 | C, E, G | | 1 | a = {0, 0, 0} |
| 2 | E, G | C | 1 | b = {+12, 0, 0} |
| 3 | G | C, E | 1 | c = {+12, +12, 0} |
| 4 | C, G | E | 1 | d = {0, +12, 0} |
| 5 | | C, E, G | 2 | a = {0, 0, 0} |
| 6 | C | E, G | 2 | b = {+12, 0, 0} |
| 7 | C, E | G | 2 | c = {+12, +12, 0} |
| 8 | E | C, G | 2 | d = {0, +12, 0} |

The node $A_1$ represents the loudness of the fundamental tone and the harmonics thereof for a root tone, and includes three elements, the fundamental tone ($A_{11}$), the second harmonic ($A_{12}$), and the third harmonic ($A_{13}$). Also, the value of the node $A_1$ can be a continuous value. The prior distribution of the node $A_1$ is assumed to be three-dimensional Gaussian distribution.

The node $A_2$ represents the loudness of the fundamental tone and the harmonics thereof for a third, and includes three elements, the fundamental tone ($A_{21}$), the second harmonic ($A_{22}$), and the third harmonic ($A_{23}$). Also, the value of the node $A_2$ can be a continuous value. The prior distribution of the node $A_2$ is assumed to be three-dimensional Gaussian distribution.

The node $A_3$ represents the loudness of the fundamental tone and the harmonics thereof for a fifth, and includes three elements, the fundamental tone ($A_{31}$), the second harmonic ($A_{32}$), and the third harmonic ($A_{33}$). Also, the value of the node $A_3$ can be a continuous value. The prior distribution of the node $A_3$ is assumed to be three-dimensional Gaussian distribution.

The node W represents the loudness of the tones other than the chord component tones, that is to say, the loudness of tones that are not the tones included in the chord. Since the third harmonic of the root tone and the second harmonic of the fifth overlap each other, the node includes 24−9+1=16 elements ($W_1$ to $W_{16}$). Also, the value of the node W can be a continuous value. The prior distribution of the node W is assumed to be independent for each tone and identical Gaussian distribution. In this regard, the average value and the variance parameters are set from the statistics of the non-chord component tones of the correct answer data.

The node N represents the loudness of each tone of the scale component information, that is to say, it represents 24 tones, and includes 24 elements ($N_1$ to $N_{24}$). Also, the node N can be a continuous value.

For the other nodes, the node R, the node C, and the node M are the same as those in the case of estimating a triad from 12 tones, and thus their description will be omitted.

In the Bayesian network structure having the individual nodes described above, the node M is provided as a child node of the nodes R, C, O, and I, and the node N is provided as a child node of the node M. Also, the node N is a child node of the nodes $A_1$ to $A_3$ and W.

When a Bayesian network is learned, a correct answer root and a correct answer chroma are given to the nodes R and C, and the scale component information including 24 tones is given to the node N, and thereby the parameters of the nodes $A_1$ to $A_3$ are learned. The learned parameters are stored in the parameter storage section 15. On the other hand, when a chord is estimated using the Bayesian network after the learning, the learned parameters are read from the parameter storage section 15 and the scale component information including 24 tones is given to the node N, and thereby the posterior probabilities of the root and the chroma at the nodes R and C are calculated. Then, the combination of the root and the chroma having the highest posterior probability is output as an estimated chord.

An example in which a Bayesian network was actually learned and a chord was estimated is shown as follows. For the musical signal of 26 pieces of music (popular music in Japan and English-speaking countries), the start time, the end time, the root and the chroma of the portions that were determined to be sounding a chord by a human being are recorded. All the correct answer data includes 1331 correct answer samples. The observed values (scale component information including 24 tones) weighed by a Gaussian curve, the correct answer roots, and the correct answer chromas are given to the Bayesian network. Then, for the nodes $A_1$ to $A_3$, three parameters as the average values and six parameters as covariance diagonal elements were learned using the EM method. In this regard, the covariance elements have six parameters for the following reason. That is to say, the covariance of the distribution of the loudness of the fundamental tone, the second and third harmonics thereof can be expressed by a 3×3 matrix. However, six elements other than the diagonal elements are symmetrical with respect to a diagonal, and thus independent elements are six.

After the Bayesian network was learned in this manner, a chord was estimated using the same observed values as that used in the learning. The result is that correct answers are obtained for 1083 samples out of 1331 samples, and thus the correct answer rate was 81.4%.

Furthermore, the correct answer data was sorted in the order of occurrence sequence, and was grouped into two groups, an odd entry group and an even entry group. When the learning was done with odd entries and the evaluation was done with even entries, the correct answer rate was 81.4%. Also, when the learning was done with the even entries and the evaluation was done with the odd entries, the correct answer rate was 81.1%. The correct answer rate has not changed much between the two, and thus it is understood that the correct answer rate has increased not by the over-fitting to the correct answer data.

3. Estimation of Triad and Tetrachord from 24 Tones

Expansion to Tetrachord

Figure 6:
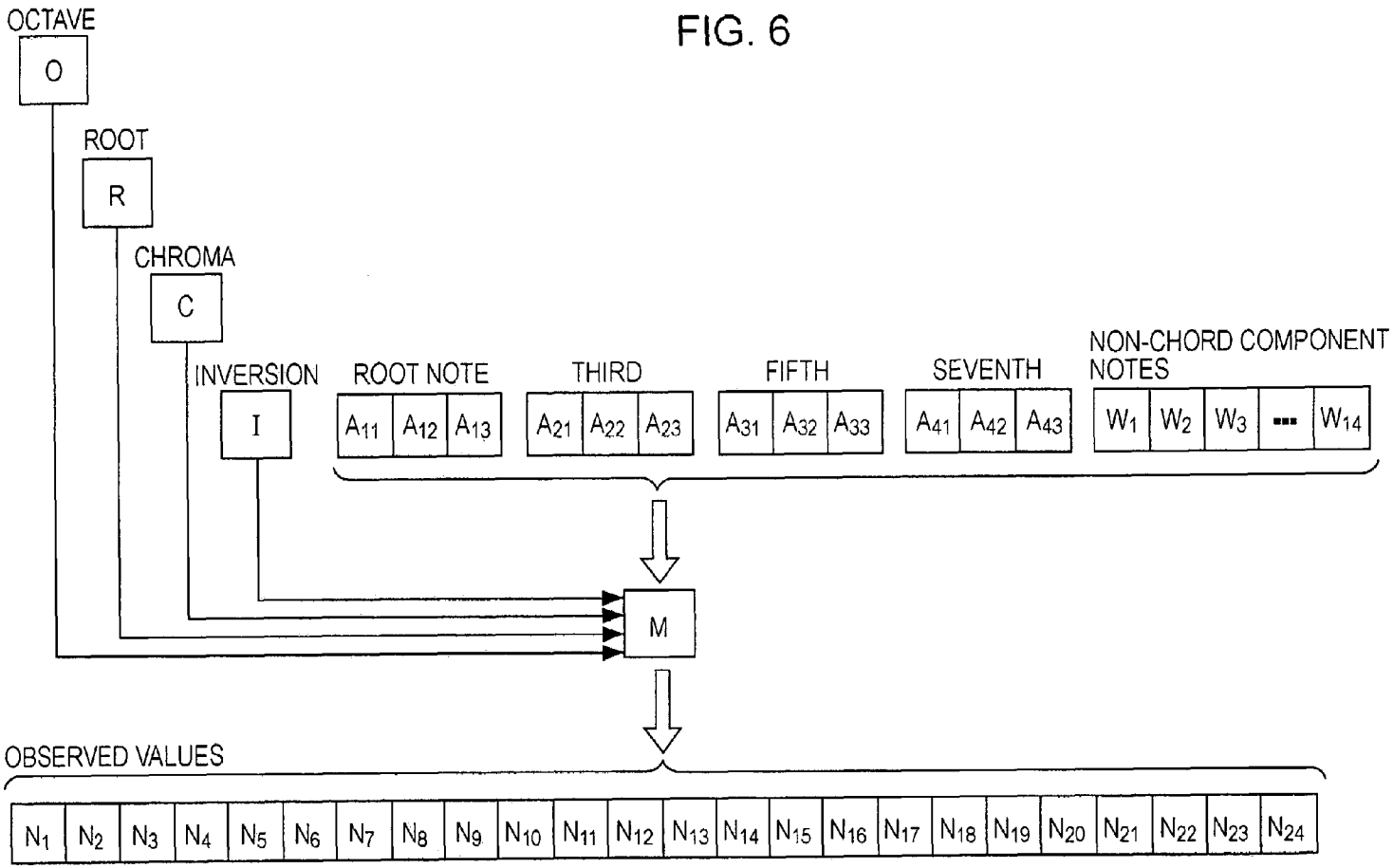
FIG. 6 is a diagram illustrating a model for estimating a tetrachord from 24 tones.
Figure 7:
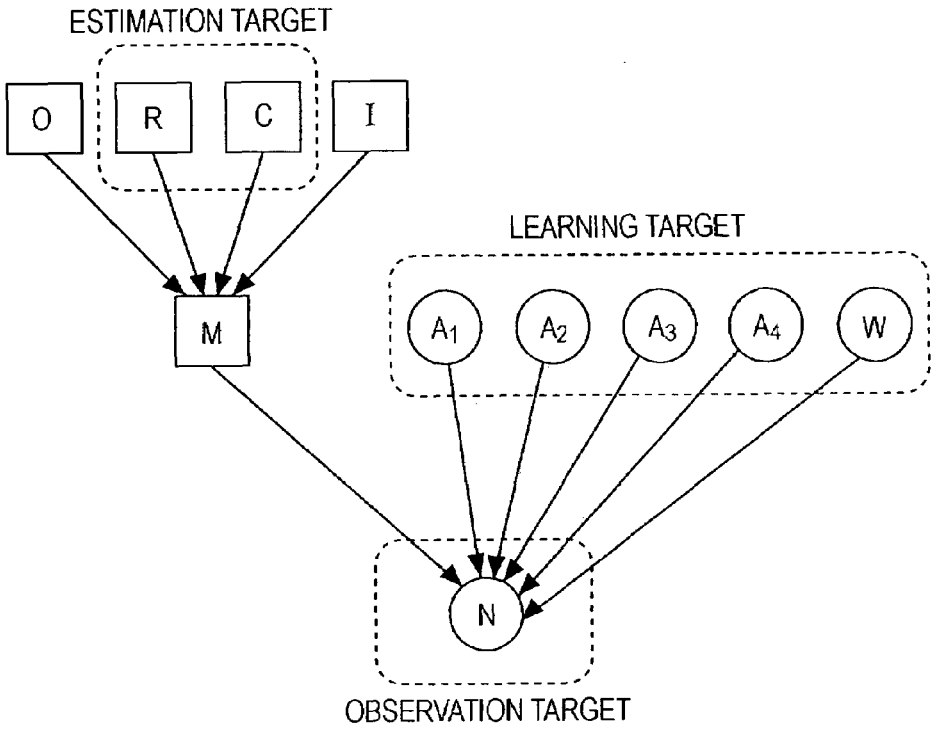
FIG. 7 is a diagram illustrating a Bayesian network structure for estimating a tetrachord from 24 tones.

As shown in FIG. 6, in the estimation of a triad and a tetrachord from 24 tones, an observation model is assumed in combination of a root tone, a third, a fifth, a seventh, the second and third harmonics thereof and the other tones in accordance with a root, a chroma, an octave, and inversion. This model is expressed by the Bayesian network structure as shown in FIG. 7. The characteristics of each node are shown in the following Table 5.

TABLE 5

| Node | | Characteristic | Prior Distribution |
|---|---|---|---|
| O | Octave | 1 Element · 2 Values | Uniform Distribution |
| R | Root | 1 Element · 12 Values | Uniform Distribution |
| C | Chroma | 1 Element · 2 to 7 Values | Uniform Distribution |
| I | Inversion | 1 Element · 8 Values | Uniform Distribution |
| $A_1$ | Loudness of Fundamental Tone and Harmonics | 3 Elements · Continuous Value | Three Dimensional Gaussian Distribution |
| $A_2$ | Loudness of Third and Harmonics | 3 Elements · Continuous Value | Three Dimensional Gaussian Distribution |
| $A_3$ | Loudness of Fifth and Harmonics | 3 Elements · Continuous Value | Three Dimensional Gaussian Distribution |
| $A_4$ | Loudness of Seventh and Harmonics | 3 Elements · Continuous Value | Three Dimensional Gaussian Distribution |
| W | Loudness of Non-chord Component Tones | 16 Elements · Continuous Value | Independent Identical Gaussian Distribution |
| M | Mixture | Virtual Node | |
| N | Observation | 24 Elements · Continuous Value | |

The node C represents a chroma, and includes one element. Also, the value of the node C can be two to seven values selected from major, minor, diminish, augment, major seventh, minor seventh, dominant seventh. The node C is an estimation target, and thus the prior distribution is assumed to be uniform distribution.

The node I represents the inversion, and includes one element. Also, the value of the node I can be one of eight values. The prior distribution of the node I is assumed to be uniform distribution.

The node $A_4$ represents the loudness of the fundamental tone and the harmonics thereof for a seventh, and includes three elements, the fundamental tone ($A_{41}$), the second harmonic ($A_{42}$), and the third harmonic ($A_{43}$). Also, the value of the node $A_4$ can be a continuous value. The prior distribution of the node $A_4$ is assumed to be three-dimensional Gaussian distribution.

The node W represents the loudness of the tones other than the chord component nodes, that is to say, the loudness of tones that are not the tones included in the chord and the harmonics thereof. The node W includes 16 elements ($W_1$ to $W_{16}$). Also, the value of the node W can be a continuous value. The prior distribution of the node W is assumed to be independent for each tone and identical Gaussian distribution. In this regard, the average value and the variance parameters are set from the statistics of the non-chord component tones of the correct answer data.

For the other nodes, the node R, the nodes $A_1$ to $A_3$, and the nodes M and N are the same as those in the case of estimating a triad from 24 tones, and thus their description will be omitted.

In the Bayesian network structure having the individual nodes described above, the node M is provided as a child node of the nodes R, C, O, and I, and the node N is provided as a child node of the node M. Also, the node N is a child node of the nodes $A_1$ to $A_4$ and W.

When a Bayesian network is learned, a correct answer root and a correct answer chroma are given to the nodes R and C, and the scale component information including 24 tones is given to the node N, and thereby the parameters of the nodes $A_1$ to $A_4$ are learned. The learned parameters are stored in the parameter storage section 15. On the other hand, when a chord is estimated using the Bayesian network after the learning, the learned parameters are read from the parameter storage section 15 and the scale component information including 24 tones is given to the node N, and thereby the posterior probabilities of the root and the chroma at the nodes R and C are calculated. Then, the combination of the root and the chroma having the highest posterior probability is output as an estimated chord.

An example in which a Bayesian network was actually learned and a chord was estimated is shown as follows. A musical signal having a known chord progression (including chords other than a major/minor) was created using Band-in-a-Box, which is automatic accompaniment software, and the chords were used as correct answer data. At this time, the song settings are determined such that the options of "use pedal bass in middle chorus" and "add figuration to chord" were set to off. In the learning and estimation of a chord, one time period was not set to be the time from one beat to the next beat as described above, but was set to be the time from the beginning of a bar to the end of the bar. The observed values (scale component information including 24 tones), the correct answer roots, and the correct answer chromas are given to the Bayesian network. Then, for each of the nodes $A_1$ to $A_3$, three parameters as the average values and six parameters as covariance elements were learned using the EM method. In this regard, the learning data of the node $A_4$ has three parameters as the average values and six parameters as covariance elements, but the number of the correct answer data was not sufficient, and thus the parameters of the nodes $A_2$ and $A_3$ were used.

After the Bayesian network was learned in this manner, a chord was estimated using the same observed values as that used in the learning. When the value of the node C was assumed to be one of two values, major or minor, the correct answer rate was 97.2%. The reason why the correct answer rate is higher compared with the case of actual musical signal is considered to be that vocals and effect sound etc., are not included.

Also, when the value of the node C was assumed to be one of four values, major, minor, diminish, and augment, the correct answer rate was 91.7%.

Also, when the value of the node C was assumed to be one of three values, major, minor, and dominant seventh, the correct answer rate was 81.9%. In this regard, almost all the incorrect answers were due to the confusion between major and dominant seventh. This is because the lower three tones of dominant seventh constitute major.

Furthermore, when the value of the node C was assumed to be one of five values, major, minor, dominant seventh, major seventh, and minor seventh, the correct answer rate was 68.1%.

Furthermore, when the value of the node C was assumed to be one of seven values, major, minor, dominant seventh, major seventh, minor seventh, diminish, and augment, the correct answer rate was 69.2%.

As described above in detail, in the chord estimation apparatus 1 according to the present embodiment, a musical signal is subjected to Fourier Transform to generate the frequency component data. This frequency component data is mapped onto 84 tones to generate the scale component information including 84 tones. Then, the scale component information is folded for each two octaves to generate the scale component information including 24 tones, and the scale component information including 24 tones is input into the Bayesian network. Thus, it is possible to estimate a chord with a smaller amount of calculation than in the case of directly inputting the frequency component data into the Bayesian network or the case of inputting the scale component information including 84 tones into the Bayesian network. Also, in the chord estimation apparatus 1 according to the present embodiment, the scale component information including 84 tones is not folded for each one octave, but is folded for each two octaves to generate the scale component information including 24 tones. Thus, the harmonic structure can be considered, and a chord can be estimated with more accuracy than in the case of using the scale component information including 12 tones. A chord played in a music and the time progression thereof are related to the atmosphere and the music structure of the music, and thus it is useful for the estimation of the meta-information of the music to estimate a chord in this manner.

In this regard, the present invention is not limited to the embodiment described above, and various modifications are possible without departing from the spirit and scope of the present invention as a matter of course.

For example, in the above-described embodiment, a description has been given of the case of constituting the apparatus by hardware. However, the present invention is not limited to this, and arbitrary processing can be achieved by causing a CPU (Central Processing Unit) to execute a computer program. In this case, the computer program can be provided as a recording medium holding the computer program. Also, the program can be provided by the transmission through a transmission medium, such as the Internet, etc.

What is claimed is:

1. A chord estimation apparatus comprising:

frequency-component extraction means for extracting a frequency component from an input music signal;

scale-component information generation means for mapping the frequency component extracted by the frequency-component extraction means onto each tone and generating scale-component information including each tone and loudness thereof;

folding means for folding the scale-component information generation means for each two octaves to generate scale-component information including 24 tones; and chord estimation means for inputting the scale-component information including the 24 tones into a Bayesian network in order to estimate a chord.

2. The chord estimation apparatus according to claim 1, wherein the Bayesian network in the chord estimation means includes at least nodes of: a chord root, a chroma, an octave including the chord out of the two octaves, inversion, loudness of a root tone and harmonics thereof, loudness of a third and harmonics thereof, loudness of a fifth and harmonics thereof, loudness of tones other than the chord component tones and harmonics thereof, and the scale-component information including 24 tones.

3. The chord estimation apparatus according to claim 2, wherein the Bayesian network in the chord estimation means further includes a node on a seventh and harmonics thereof.

4. The chord estimation apparatus according to claim 1, wherein the scale-component information generation means generates the scale-component information by mapping the frequency component extracted by the frequency-component extraction means onto each tone and adding loudness of each tone for a predetermined time range.

5. The chord estimation apparatus according to claim 1, wherein the folding means normalizes the generated scale-component information including 24 tones by loudness of a largest interval out of the 24 tones.

6. A method of estimating a chord, comprising the steps of:

extracting a frequency component from an input music signal;

mapping the frequency component extracted by the step of extracting a frequency component onto each tone and generating scale-component information including each tone and loudness thereof;

folding the scale-component information generated by the step of generating scale-component information for each two octaves to generate scale-component information including 24 tones; and inputting the scale-component information including the 24 tones into a Bayesian network in order to estimate a chord.

7. A chord estimation apparatus comprising:

a frequency-component extraction mechanism for extracting a frequency component from an input music signal;

a scale-component information generation mechanism for mapping the frequency component extracted by the frequency-component extraction mechanism onto each tone and generating scale-component information including each tone and loudness thereof;

a folding mechanism for folding the scale-component information generated by the scale-component information generation mechanism for each two octaves to generate scale-component information including 24 tones; and a chord estimation mechanism for inputting the scale-component information including the 24 tones into a Bayesian network in order to estimate a chord.

* * * * *